US008707940B2

(12) United States Patent
Zheng et al.

(10) Patent No.: US 8,707,940 B2
(45) Date of Patent: Apr. 29, 2014

(54) LAUNCHER

(75) Inventors: Yu Zheng, Walnut, CA (US); Jorge Nunes Lourenco, Glendora, CA (US)

(73) Assignee: Patent Category Corp., Walnut, CA (US)

( * ) Notice: Subject to any disclaimer, the term of this patent is extended or adjusted under 35 U.S.C. 154(b) by 143 days.

(21) Appl. No.: 13/477,896

(22) Filed: May 22, 2012

(65) Prior Publication Data

US 2013/0312725 A1 Nov. 28, 2013

(51) Int. Cl.
*F41B 11/00* (2013.01)

(52) U.S. Cl.
USPC ..... 124/64; 124/56

(58) Field of Classification Search
USPC ..... 124/56, 59–61, 63, 64
See application file for complete search history.

(56) References Cited

U.S. PATENT DOCUMENTS 3,262,440 A * 7/1966 Kuhn ..... 124/67
3,584,614 A * 6/1971 Horvath ..... 124/56
4,768,681 A * 9/1988 Dean et al. ..... 222/79
5,242,323 A * 9/1993 Rappaport ..... 446/180
5,359,985 A * 11/1994 Schumacher ..... 124/66
5,471,968 A * 12/1995 Lee ..... 124/64
5,681,043 A * 10/1997 Winblad et al. ..... 273/317.3
5,711,285 A * 1/1998 Stewart et al. ..... 124/67
5,901,693 A * 5/1999 Smith ..... 124/66
6,067,975 A * 5/2000 Ginn ..... 124/59
6,523,535 B2 * 2/2003 Rehkemper et al. ..... 124/78
7,628,671 B2 * 12/2009 Choi ..... 446/57
7,841,327 B2 * 11/2010 Sopinsky et al. ..... 124/16
7,987,841 B2 * 8/2011 Bernstein et al. ..... 124/64
8,057,309 B1 * 11/2011 Mead et al. ..... 463/48
8,082,909 B2 * 12/2011 Sopinsky et al. ..... 124/16
8,118,637 B2 * 2/2012 De La Torre ..... 446/473
8,196,571 B2 * 6/2012 Jenson ..... 124/73
8,567,378 B2 * 10/2013 Nugent ..... 124/59

* cited by examiner

*Primary Examiner* — Michael David
(74) *Attorney, Agent, or Firm* — Raymond Sun

(57) ABSTRACT

A launcher has a base having a pair of opposite supports that define a channel therebetween, a hub having a body that defines a hollow interior, an inlet tube extending through the body into the hollow interior, and an outlet tube extending through the body into the hollow interior. A first tube connects the bellows to the inlet tube, and a second tube connects the outlet tube to the object. The base and the hub are constructed so that the position of the hub inside the channel can be adjusted to allow the outlet tube to be oriented at different angles.

4 Claims, 9 Drawing Sheets

FIG. 13
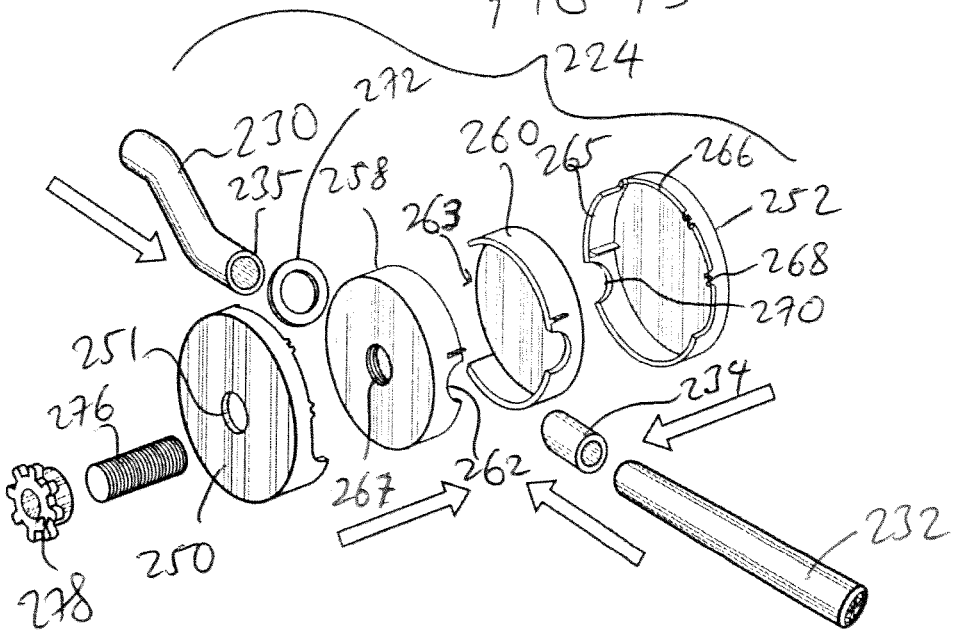
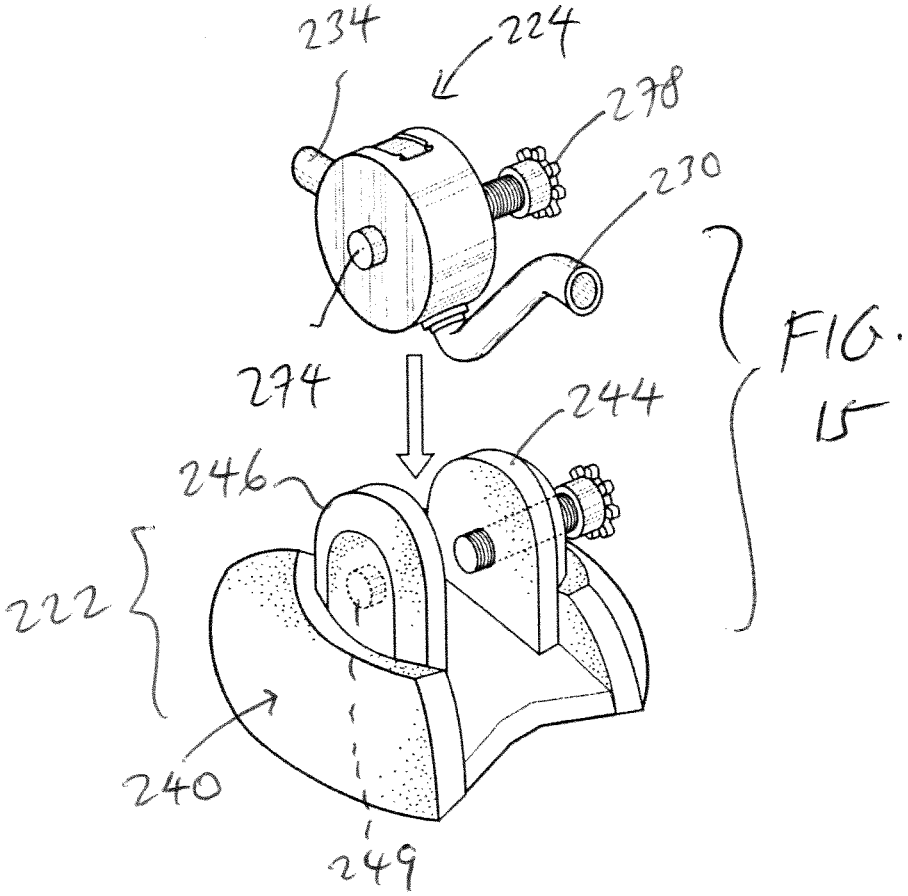
FIG. 15

(A)
(B)
224
228
232
240
230
256
268

(A)
(B)
224
228
232
240
230
256
268

(A)
(B)
220
224
228
232
240
230
256
268

LAUNCHER

BACKGROUND OF THE INVENTION

1. Field of the Invention

The present invention is directed to toys, and in particular, to a launcher that can be used to launch objects at different angles.

2. Description of the Prior Art

Launching toys have have always been popular among boys and girls. Simple air launchers send projectiles up in the air at predetermined angles, directions, or speed. The conventional launchers do not allow for much variation or variety. Thus, there remains a need for a launching toy that provides increased variety of play, and added entertainment, to the user.

SUMMARY OF THE DISCLOSURE

It is one objective of the present invention to provide a launcher that can launch an object at different angles or positions.

To accomplish the objectives set forth above, the present invention provides a launcher having a base having a pair of opposite supports that define a channel therebetween, a hub having a body that defines a hollow interior, an inlet tube extending through the body into the hollow interior, and an outlet tube extending through the body into the hollow interior. A first tube connects an air bellows to the inlet tube, and a second tube connects the outlet tube to the object. The base and the hub are constructed so that the position of the hub inside the channel can be adjusted to allow the outlet tube to be oriented at different angles.

BRIEF DESCRIPTION OF THE DRAWINGS

FIG. 13 is an exploded perspective view of the hub of the launcher of FIG. 11.

FIG. 15 is a rear exploded perspective view of the launcher of FIG. 11.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

The present invention provides a launcher which can be oriented in a variety of different configurations to allow objects to be launched at a variety of angles and heights. The present invention accomplishes this by providing hub and base constructions which allow the ejecting tube to be oriented at a variety of different angles and heights.

Figure 2:
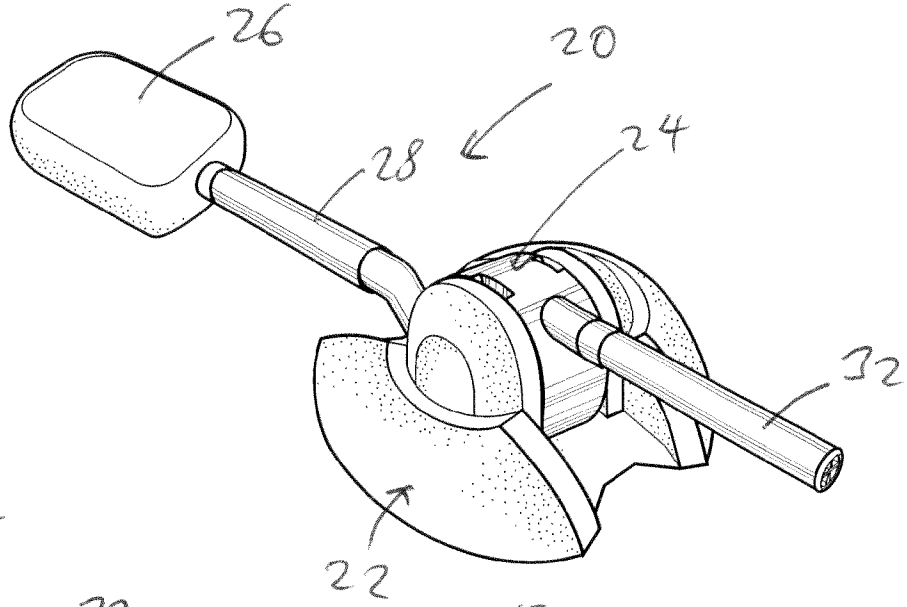
FIG. 2 is a perspective view of the launcher of FIG. 1 shown assembled in a first configuration.
Figure 1:
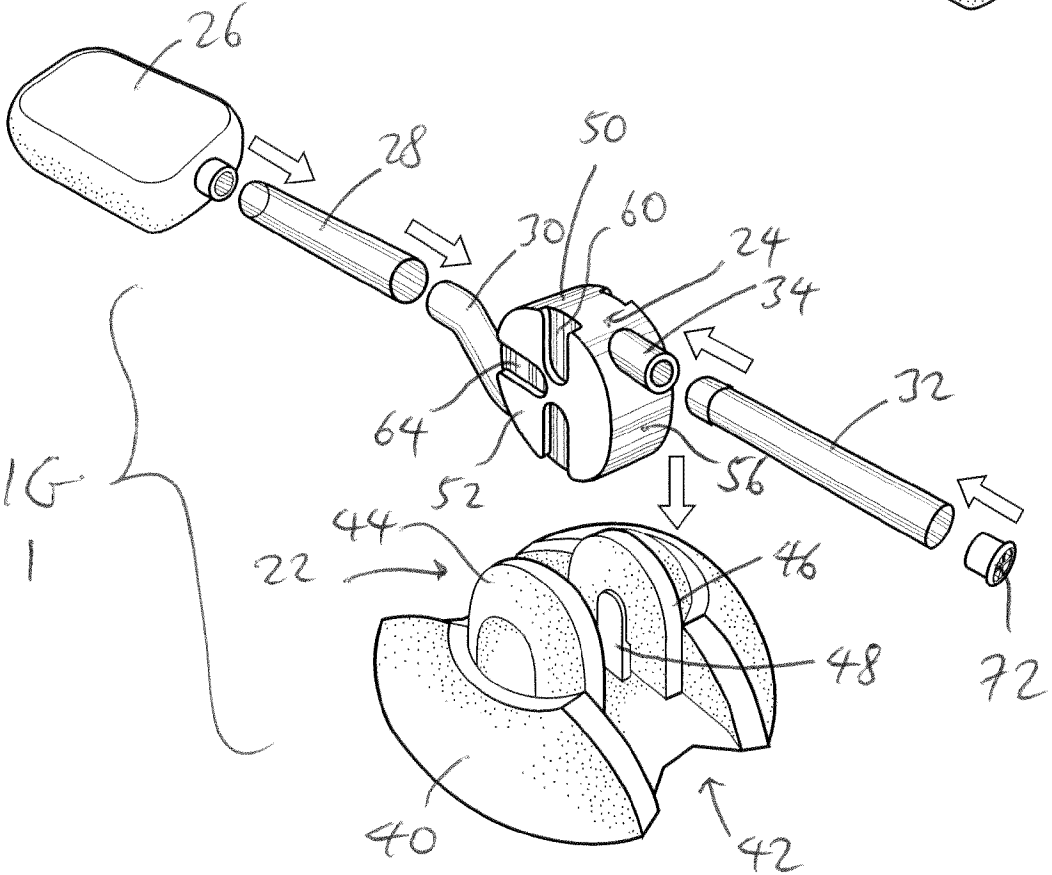
FIG. 1 is an exploded perspective view of a launcher according to one embodiment of the present invention.
Figure 3:
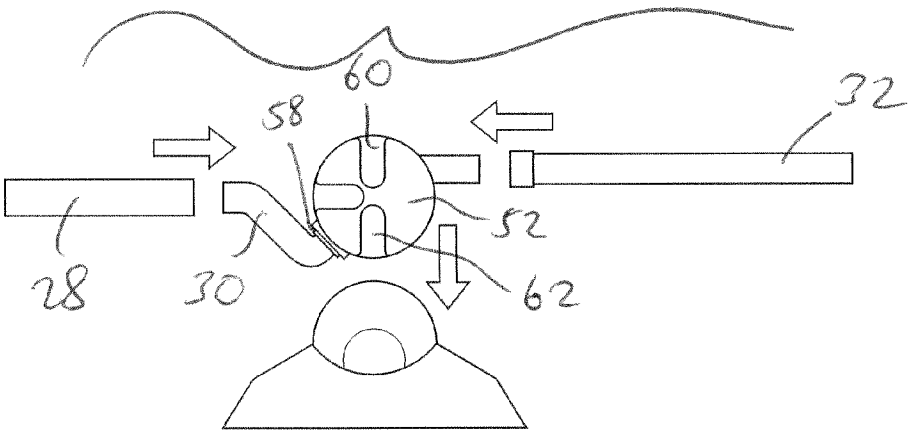
FIG. 3 is an exploded side view of the launcher of FIG. 1 in the first configuration of FIG. 2.

FIGS. 1-3 illustrate a launcher 20 according to one embodiment of the present invention. The launcher 20 has a base 22, a hub 24 that is adapted to be seated in the base 22, and an air bellows 26 is that is adapted to provide air (or water) to the hub 24 to launch an object. A first tube 28 couples the bellows 26 to an inlet tube 30 that extends from the hub 24, and a second tube 32 couples an outlet tube 34 from the hub 24 to an object that is intended to be launched.

The base 22 has a body 40 with an enlarged bottom surface, and the body 40 has a channel 42 extending through it. Opposing first and second supports 44 and 46 extend vertically upwardly from the channel 42 to define the channel 42, and a tongue 48 is provided against the flat inner surface of each support 44, 46, so that the two tongues 48 are facing each other in the channel 42. Only one tongue 48 is shown on the inner surface of support 46 in FIG. 1; there is another tongue 48 on the inner surface of the support 44 but is not visible from the view in FIG. 1. Each tongue 48 is elongated and is configured with two long edges connected at the top by a rounded edge.

The hub 24 has a generally circular and hollow body 50 that is formed by a first flat wall 52, a second flat wall 54, and a circumferential wall 56 that connects the first and second walls 52, 54. The inlet tube 30 extends from a port 58 in the circumferential wall 56 at a location that is at about the 7:30 position of the hub 24, when viewed from the orientation shown in FIG. 3. In the FIG. 3 orientation, the first wall 52 is facing the reader. The inlet tube 30 is shaped like an inverted "S", with one end connected to the port 58 and the opposite end extending generally horizontally along the 9:00 position (as viewed from the orientation of FIG. 3) of the hub 24 to connect the first tube 28. An outlet tube 34 extends horizontally along the 1:00 o'clock position (as viewed from the orientation of FIG. 3) of the hub 24 to connect the second tube 32.

Three slots 60, 62 and 64 are formed on the first wall 52. Each slot 60, 62, 64 extends from the edge of the first wall 52 and is elongated and is configured with two long edges connected at an inner end by a rounded edge. The slots 60, 62, 64 are sized and configured to allow a tongue 48 to be fitted therein to secure the hub 24 inside the base 22. The slots 60, 62 and 64 are positioned at the 12:00, 6:00 and 9:00 o'clock positions, respectively (as viewed from the orientation of FIG. 3), of the hub 24. Similarly, three slots 160, 162, 164 (not shown in FIG. 1, but shown in FIG. 5D) are positioned at the 12:00, 3:00 and 6:00 o'clock positions, respectively, of the second wall 54 as viewed from the opposite orientation of FIG. 3 (i.e., from the rear) of the hub 24. In other words, the locations of the slots 160, 162, 164 on the second wall 54 are aligned with the locations of the slots 60, 62, 64 on the first wall 52.

Figure 4:
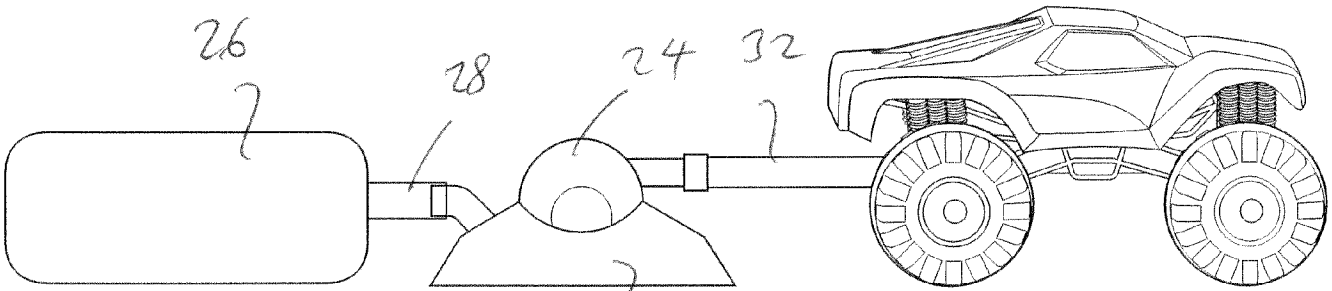
FIG. 4 is a side view showing the launcher of FIG. 1 in use with a toy vehicle in the first configuration of FIG. 2.

As shown in FIG. 3, the launcher 20 is assembled for use by attaching the tubes 28 and 32 to the port 58 and the outlet tube 34, respectively, and then attaching the bellows 26 to the other end of the tube 28. A vent cap 72 can be attached to an end of the tube 32. The hub 24 is then inserted into the channel 42 with the slot 62, and the aligned slot 162 at the 6:00 position on the second wall 54, receiving the opposite tongues 48. Since the thickness of the hub 24 is about the same as the width of the channel 42, by having the tongues 48 retained in the slots 62 and 162, the hub 24 is held in a secure manner inside the channel 42. An object (e.g., a toy vehicle as shown in FIG. 4) can be coupled to the tube 32, and be launched by pressing on the bellows 26.

Figure 5:
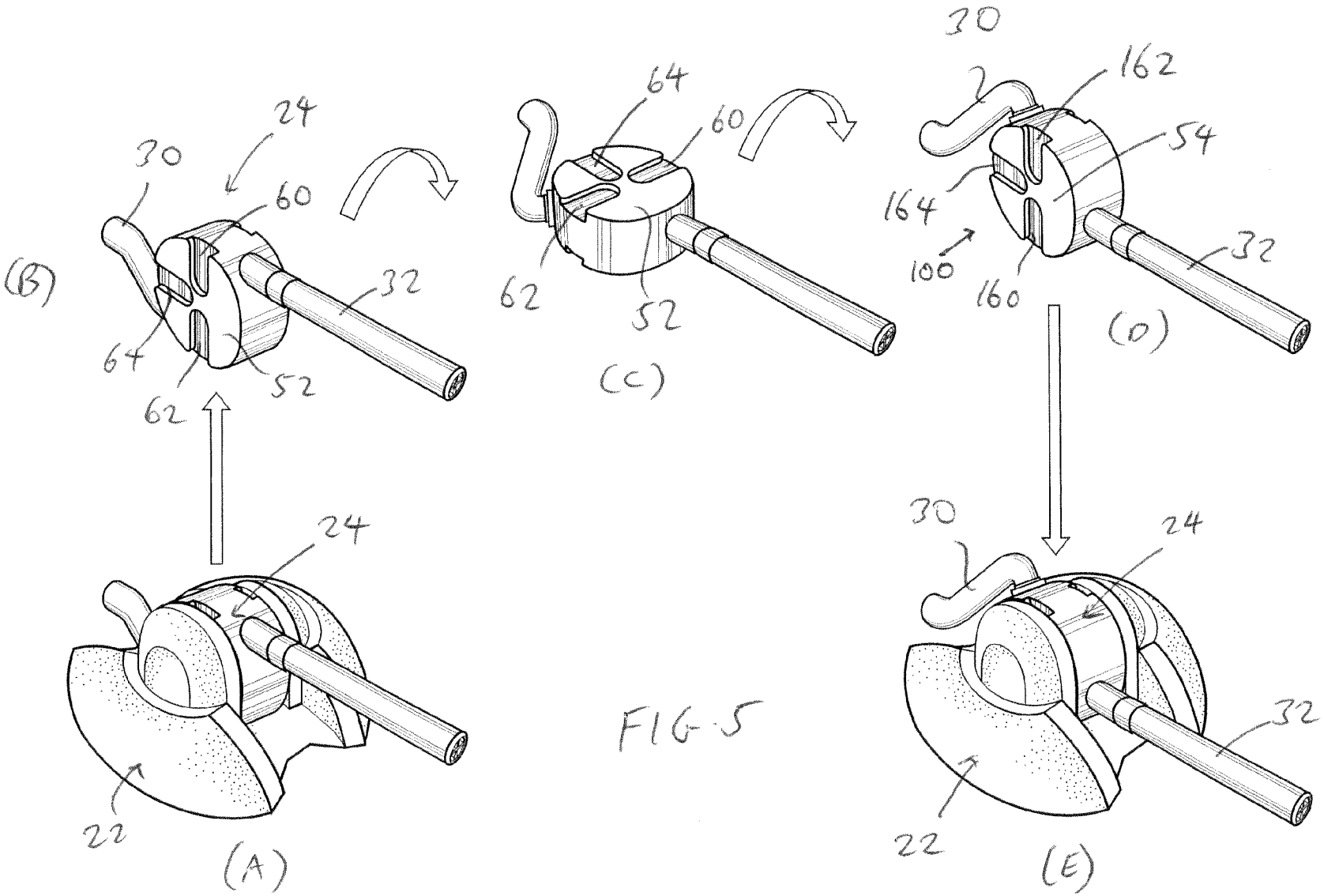
FIGS. 5A-5E illustrate how the launcher of FIG. 1 can be adjusted from the first configuration to a second configuration.

The hub 24 of the launcher 20 can be re-oriented to allow the launcher to launch a different object from a different angle or height. Referring to FIGS. 5A-5E, the hub 24 is turned over by 360 degrees. FIG. 5A shows the hub 24 and base 22 as in FIG. 2. In FIG. 5B, the hub 24 is removed from the channel 42. FIG. 5C shows the hub 24 after it has been turned over by 180 degrees, and FIG. 5D shows the hub 24 after it has been turned over by 360 degrees. In this orientation, the slots 162, 160 and 164 are positioned at the 12:00, 6:00 and 9:00 o'clock positions, respectively (as viewed from the orientation of the arrow 100 in FIG. 5D). FIG. 5E shows the hub 24 now inserted into the channel 24, with the tongues 48 retained in the slots 60 and 160. In this configuration (see FIG. 6), the port 58 is now positioned at about the 10:30 o'clock position (as viewed from the orientation of the arrow 100 in FIG. 5D), and the outlet port 34 extends horizontally along the 4:00 position (as viewed from the orientation of the arrow 100 in FIG. 5D) of the hub 24 to connect the second tube 32. An object (e.g., a toy motorcycle as shown in FIG. 7) can be coupled to the tube 32, and be launched by pressing on the bellows 26.

Figure 6:
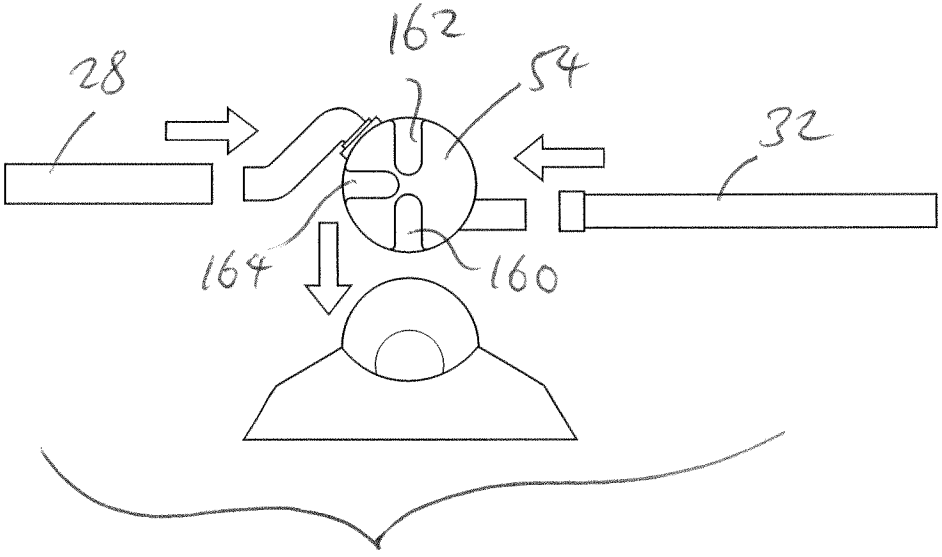
FIG. 6 is an exploded side view of the launcher of FIG. 1 in the second configuration of FIG. 5E.
Figure 7:
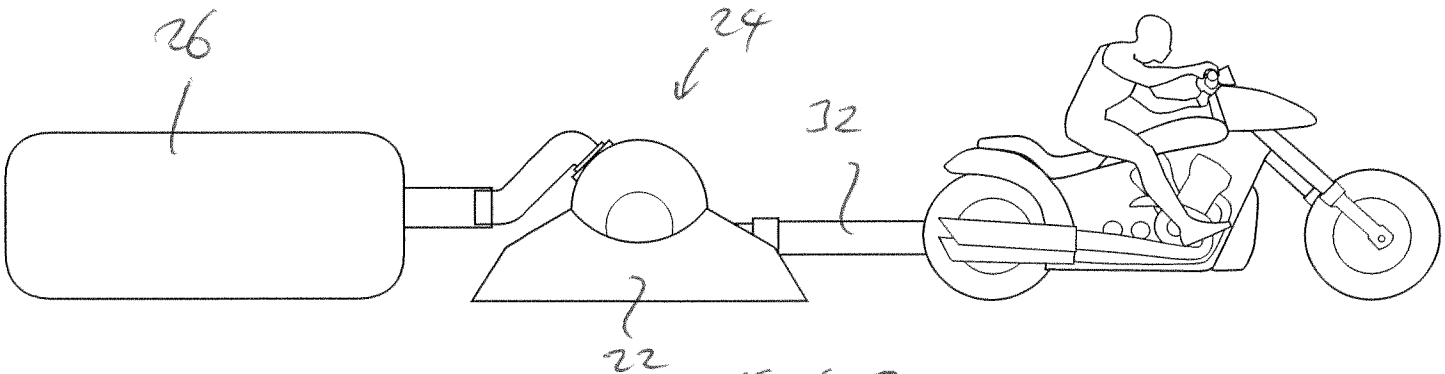
FIG. 7 is a side view showing the launcher of FIG. 1 in use with a toy motorcycle in the second configuration of FIG. 5E.

It can be seen that the tube 32 that connects to the object is at a different height in this configuration of FIGS. 6-7 (i.e., lower horizontal level) when compared with the embodiment in FIGS. 1-4 (i.e., higher horizontal height). These different heights are due to the fact that different objects are being connected to the launcher 20. Thus, the fact that the hub 24 can be turned around allows the launcher 20 to be used with different objects where the connection is at different heights.

Figure 8:
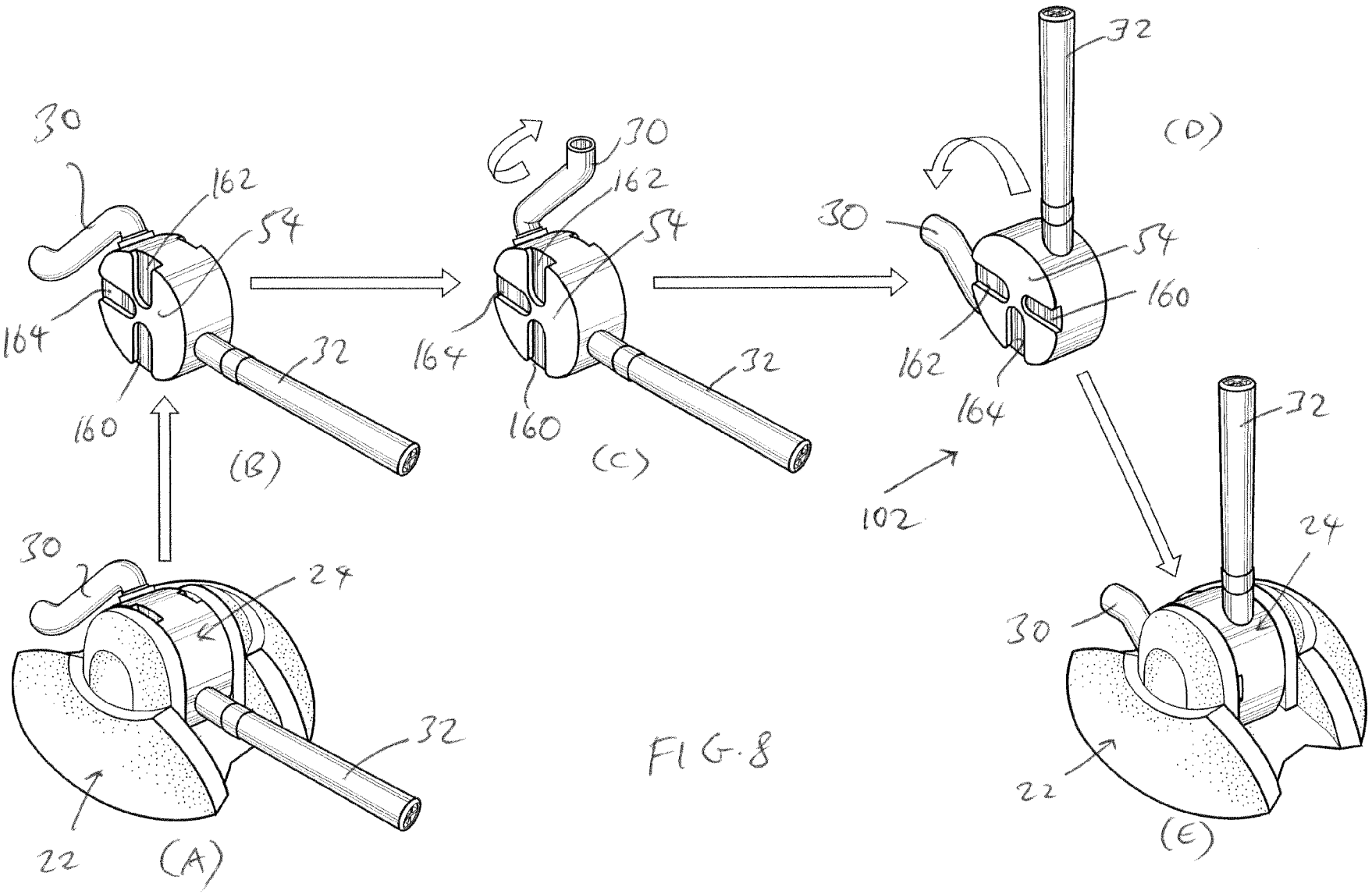
FIGS. 8A-8E illustrate how the launcher of FIG. 1 can be adjusted from the second configuration to a third configuration.

The hub 24 of the launcher 20 can be further re-oriented to allow the launcher to launch a different object from a different angle. Referring to FIGS. 8A-8E, the hub 24 is turned by ninety degrees and the inlet tube 30 is twisted by 180 degrees. FIG. 8A shows the hub 24 and base 22 as in FIG. 5E. In FIG. 8B, the hub 24 is removed from the channel 42. FIG. 8C shows the inlet tube 30 twisted by 180 degrees to the left or the right, and FIG. 8D shows the hub 24 after it has been turned by ninety degrees so that the tube 32 now points vertically upwardly. In this orientation, the slots 160, 164 and 162 are positioned at the 3:00, 6:00 and 9:00 o'clock positions, respectively (as viewed from the orientation of the arrow 102 in FIG. 8D). FIG. 8E shows the hub 24 now inserted into the channel 24, with the tongues 48 retained in the slots 64 and 164. In this configuration (see FIG. 9), the port 58 is now positioned at about the 7:30 o'clock position (as viewed from the orientation of the arrow 102 in FIG. 8D), and the outlet port 34 extends vertically from the 12:00 o'clock position (as viewed from the orientation of the arrow 102 in FIG. 8D) of the hub 24 to connect the second tube 32. An object (e.g., a toy character as shown in FIG. 10) can be coupled to the tube 32, and be launched vertically by pressing on the bellows 26.

Figure 10:
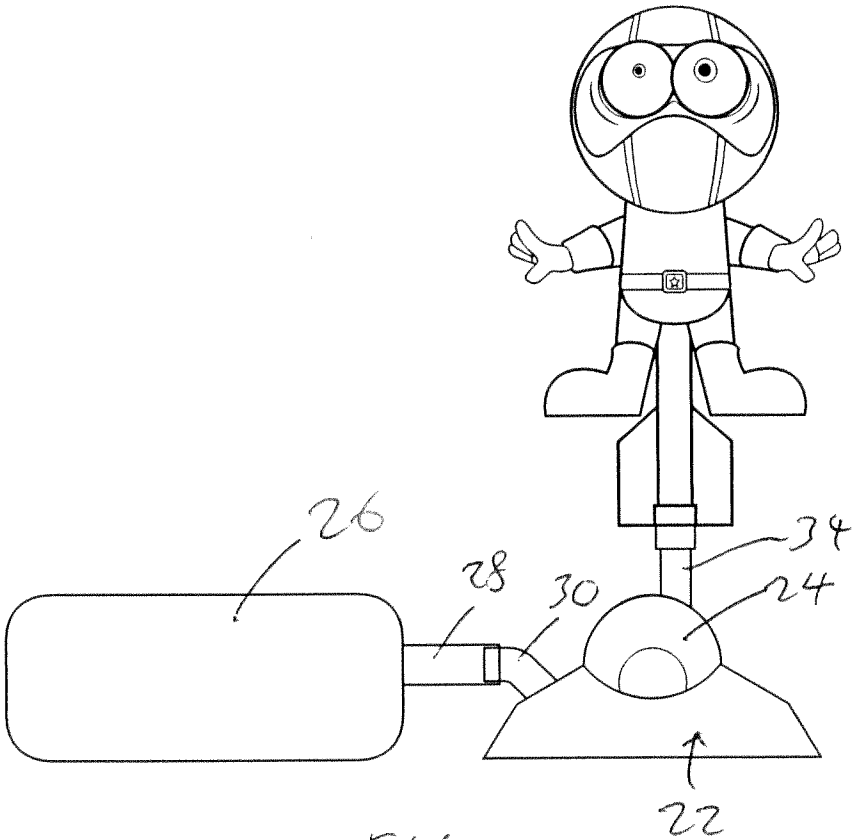
FIG. 10 is a side view showing the launcher of FIG. 1 in use with a toy character in the third configuration of FIG. 8E.
Figure 9:
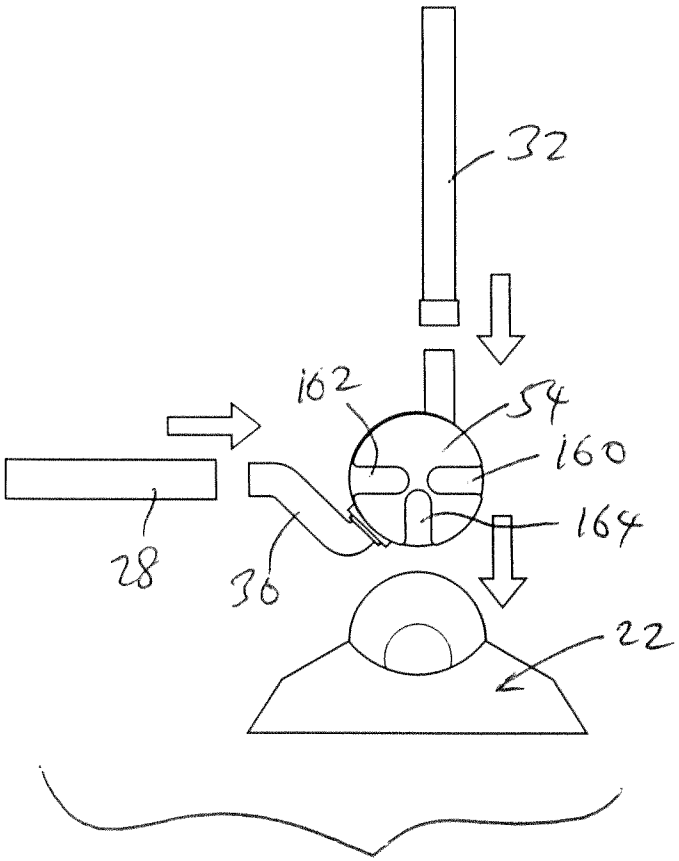
FIG. 9 is an exploded side view of the launcher of FIG. 1 in the third configuration of FIG. 8E.
Figure 11:
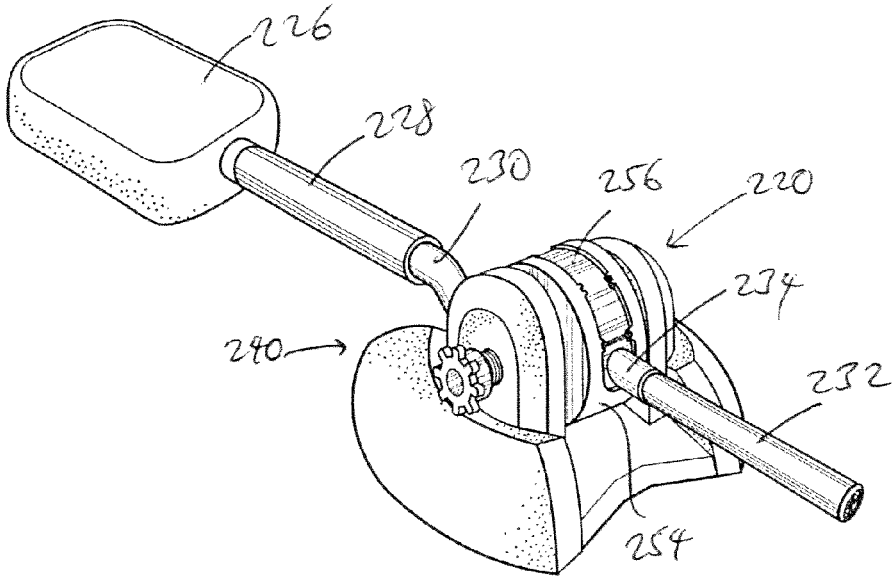
FIG. 11 is an exploded perspective view of a launcher according to another embodiment of the present invention.
Figure 12:
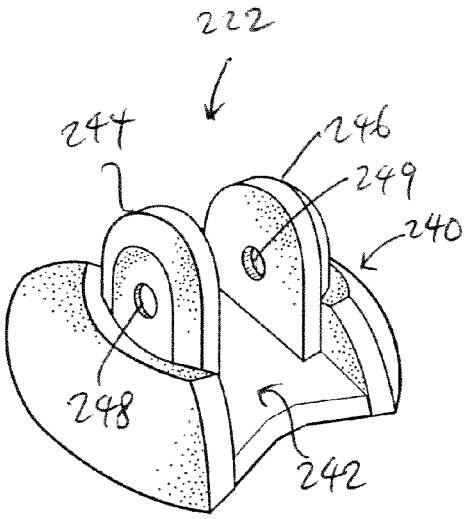
FIG. 12 is a perspective view of the base of the launcher of FIG. 11.

It can be seen that the tube 32 that connects to the object is at a different angle in this configuration of FIGS. 9-10 when compared with the configurations in FIGS. 1-4 and 6-7. Thus, the fact that the hub 24 can be turned allows the launcher 20 to launch objects from different angles.

FIGS. 11-15 illustrate a launcher 220 according to another embodiment of the present invention. The launcher 220 has a base 222, a hub 224 that is adapted to be seated in the base 222, and an air bellows 226 is that is adapted to provide air to the hub 224. A first tube 228 couples the bellows 226 to an inlet tube 230 that extends from the hub 224, and a second tube 232 couples an outlet tube 234 from the hub 224 to an object that is intended to be launched.

The base 222 has a body 240 with an enlarged bottom surface, and the body 240 has a channel 242 extending through it. Opposing first and second supports 244 and 246 extend vertically upwardly from the channel 242, an opening 248 is provided in the support 244, and a notch 249 is provided in the inner surface of the support 246, so that the opening 248 and the notch 249 are horizontally aligned with each other.

The hub 224 is generally circular and has an outer housing 254 that can be made up of two shells 250, 252, and an inner housing 256 that can be made up of two shells 258, 260. The outer housing 254 is fixed, but the inner housing 256 is retained inside the outer housing 254 and can be pivoted inside the outer housing 254.

The inner housing 256 is hollow inside, and has an opening 262 on the front for receiving the outlet tube 234. A slot 263 is provided at the rear for receiving an inner end 235 of the inlet tube 230, which is adapted to be moved in a reciprocal manner inside the slot 263. A threaded notch 267 is provided in the shell 258.

The outer housing 254 has a slot 266 that is cut out of the circumferential edge 265 of a portion of each shell 250, 252, and teeth 268 are provided in an aligned manner on the edges of the slot 266 of both shells 250, 252. A threaded opening 251 is provided in the shell 250. An opening 270 is provided in the rear of the outer housing 254 to allow the inner end 235 of the tube 230 be inserted through via the use of an O-ring 272. Thus, given the construction shown in FIG. 13, the inner housing 256 can be pivoted inside the outer housing 254, with the inlet tube 230 fixed at the location of the opening 270 but being able to travel within the slot 263, and with the outlet tube 234 fixed at the location of the opening 262 but traveling within the slot 266.

Figure 14:
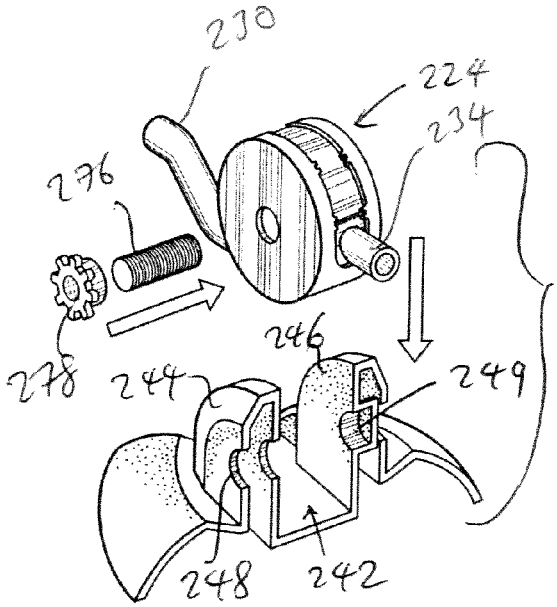
FIG. 14 is a front cut-away exploded perspective view of the launcher of FIG. 11.
Figure 16:
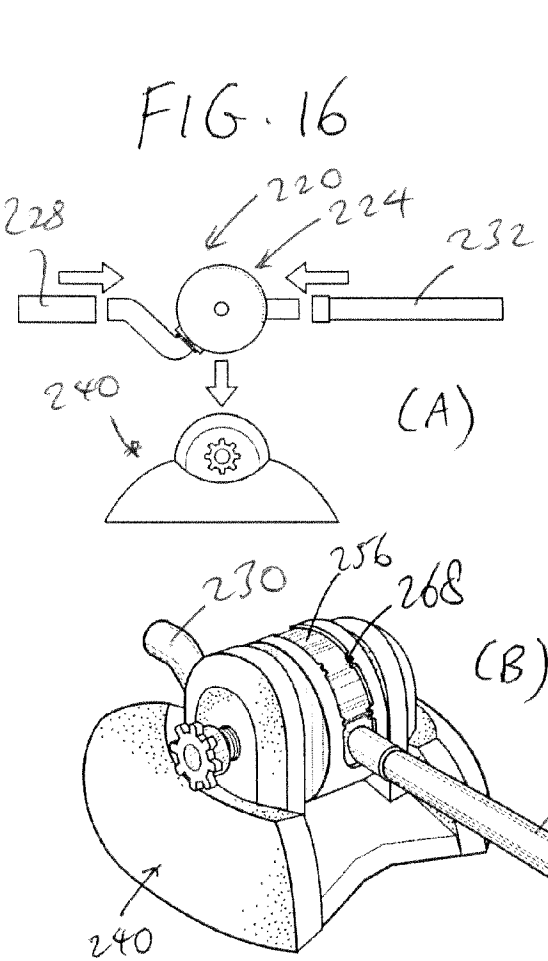
FIG. 16A is a perspective view of the launcher of FIG. 11 shown in a first position.
FIG. 16B is an exploded side view of the launcher of FIG. 11 shown in a first position.

The hub 224 is mounted to the base 222 in the manner shown in FIGS. 14-16. The hub 224 is inserted into the channel 242 of the base 222. The shell 252 has a central pin 274 extending outwardly that is fitted into the notch 249 in the support 246 (see FIG. 15), and then a threaded shaft 276 is threaded through the aligned openings 248, 251 and the notch 267 to secure the hub 224 for pivoting movement inside the channel 242. A bolt head 278 is used to secure the shaft 276. The notch 249, the pin 274, and the threaded shaft 276 can all be aligned at the same vertical level.

Figure 18:
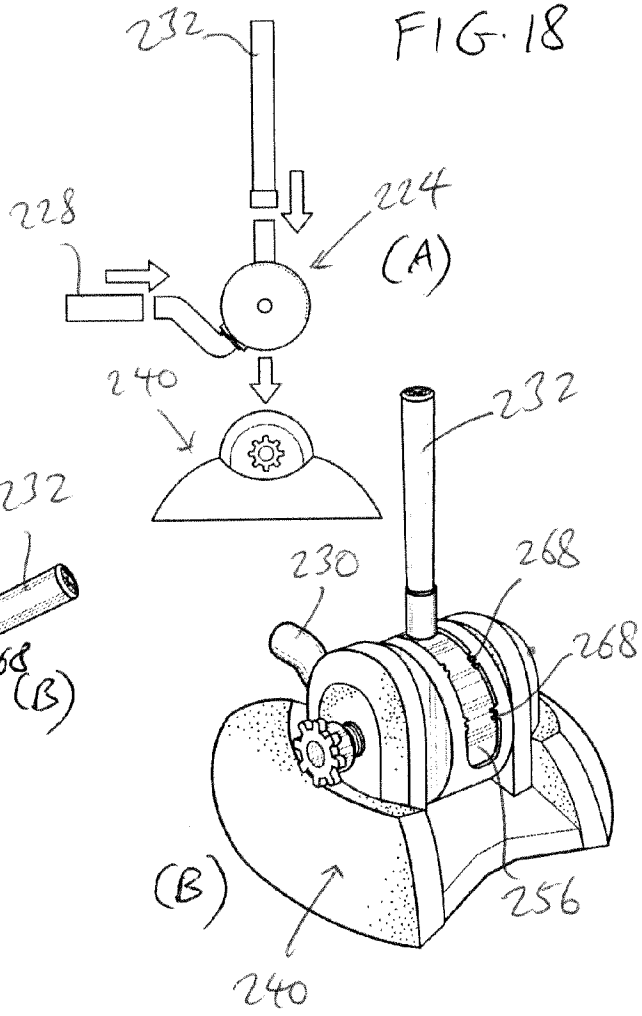
FIG. 18A is a perspective view of the launcher of FIG. 11 shown in a third position.
FIG. 18B is an exploded side view of the launcher of FIG. 11 shown in a third position.
Figure 17:
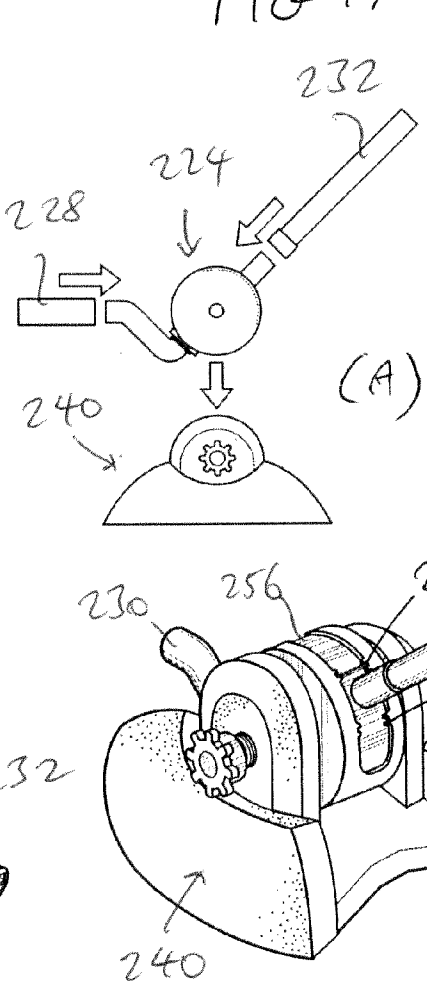
FIG. 17A is a perspective view of the launcher of FIG. 11 shown in a second position.
FIG. 17B is an exploded side view of the launcher of FIG. 11 shown in a second position.

Referring now to FIGS. 16-18, it can be seen that the outlet tube 234 (and the tube 232 carried thereon) can be easily adjusted to different positions at different angles. Starting with FIGS. 16A and 16B, the tube 232 is oriented to be substantially horizontal to ground. Referring now to FIGS. 17A and 17B, the user can now turn the bolt head 278 to pivot the inner housing 256 upwardly so that the tube 232 is now oriented at an angle of about 45 degrees with respect to the ground. The teeth 268 function to retain the tube outlet 234 in the selected position. In this regard, the space in the slot 266 between each adjacent sets of teeth 268 essentially define the positions that can be occupied by the outlet tube 234, and function to prevent the outlet tube 234 from pivoting to a different position.

Referring now to FIGS. 18A and 18B, the user can now turn the bolt head 278 to pivot the inner housing 256 upwardly again so that the tube 232 is now oriented at an angle of about 90 degrees (i.e., vertically) with respect to the ground. The teeth 268 again function to retain the outlet tube 234 in the selected position. Thus, as shown in FIGS. 16-18, the launcher 220 can be adjusted to a plurality of different orientations so that objects can be launched at different angles without the need to remove the hub 224 from the base 222.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A system for launching an object via the use of air or water, comprising:

an object;

a bellows;

a launcher, comprising:

a base having a pair of opposite supports that define a channel therebetween;

a hub having a body that defines a hollow interior, an inlet tube extending through the body into the hollow interior, and an outlet tube extending through the body into the hollow interior;

a first tube that connects the bellows to the inlet tube;

a second tube that connects the outlet tube to the object; and means provided on the base and the hub for adjusting the position of the hub inside the channel so that the outlet tube is oriented at different angles.

2. The system of claim 1, wherein the adjusting means comprises:

each support of the base has an inner surface facing the channel, and a tongue provided on the inner surface of each support; and the hub has opposite first and second walls, with a first plurality of slots formed on the first wall, and a second plurality of slots formed on the second wall, wherein each slot is sized and configured to allow a tongue to be fitted therein to secure the hub at a fixed position inside the base.

3. The system of claim 1, wherein the adjusting means comprises:

one of the supports of the base has an opening;

wherein the body comprises an inner housing and an outer housing, with the inner housing retained for pivoting motion inside the outer housing, and with the inlet tube secured to a fixed location of the outer housing, and the outlet tube secured to a fixed location of the inner housing; and wherein a pivoting shaft extends through the opening in the support, and through a portion of the outer housing and a portion of the inner housing.

4. The system of claim 3, wherein the hub includes means for retaining the inner housing at a selected location with respect to the outer housing.

* * * * *